US009630046B2

(12) United States Patent
Childs

(10) Patent No.: US 9,630,046 B2
(45) Date of Patent: Apr. 25, 2017

(54) SUPPORT APPARATUS FOR AN EXERCISE DEVICE

(71) Applicant: Escape Fitness Limited, Peterborough, Cambridgeshire (GB)

(72) Inventor: Martin Childs, Peterborough (GB)

(73) Assignee: ESCAPE FITNESS LIMITED, Peterborough (GB)

( * ) Notice: Subject to any disclaimer, the term of this patent is extended or adjusted under 35 U.S.C. 154(b) by 0 days.

(21) Appl. No.: 14/493,606

(22) Filed: Sep. 23, 2014

(65) Prior Publication Data

US 2015/0083681 A1 Mar. 26, 2015

(30) Foreign Application Priority Data

Sep. 23, 2013 (GB) ..... 1316889.3

(51) Int. Cl.

| | |
|---|---|
| ***A47F 7/00*** | (2006.01) |
| ***A63B 21/078*** | (2006.01) |
| ***A63B 17/04*** | (2006.01) |
| ***A63B 23/12*** | (2006.01) |
| ***A63B 21/00*** | (2006.01) |

(52) U.S. Cl.

CPC ..... *A63B 21/078* (2013.01); *A47F 7/00* (2013.01); *A63B 17/04* (2013.01); *A63B 21/00047* (2013.01); *A63B 23/1227* (2013.01); *A63B 2225/09* (2013.01); *A63B 2225/093* (2013.01)

(58) Field of Classification Search

CPC ... A63B 21/078; A63B 23/1227; A63B 17/04; A63B 21/00047; A63B 2225/093; A63B 2225/09; A47F 7/00

USPC ..... 211/85.7, 182, 175, 207, 208, 189; 482/104

See application file for complete search history.

(56) References Cited

U.S. PATENT DOCUMENTS

| | | | | |
|---|---|---|---|---|
| 6,746,379 | B1 * | 6/2004 | Brawner | 482/104 |
| D562,670 | S * | 2/2008 | Rogers et al. | D8/330 |
| 7,338,416 | B2 * | 3/2008 | Smith | 482/104 |
| 7,699,756 | B2 * | 4/2010 | Piane, Jr. | 482/38 |
| 8,257,233 | B2 * | 9/2012 | Rogers et al. | 482/100 |
| 8,337,370 | B2 * | 12/2012 | Rogers et al. | 482/104 |
| 2007/0155594 | A1 * | 7/2007 | Rogers et al. | 482/94 |
| 2008/0004165 | A1 * | 1/2008 | Brawner | 482/104 |
| 2012/0289384 | A1 * | 11/2012 | Staten et al. | 482/104 |

* cited by examiner

*Primary Examiner* — Basil Katcheves

(74) *Attorney, Agent, or Firm* — Troutman Sanders, LLP; Ryan A. Schneider

(57) ABSTRACT

A support apparatus for removably connecting fitness equipment to an exercise frame. The support apparatus can include first and second rack sections configured to be fixed in a spaced arrangement to a frame member, each rack section including at least one receiving channel having an opening at one end, and a bracket for supporting the exercise equipment.

17 Claims, 7 Drawing Sheets

SUPPORT APPARATUS FOR AN EXERCISE DEVICE

CROSS REFERENCE TO RELATED APPLICATIONS

This application claims the benefit of UK Patent Application No. 1316889.3, filed 23 Sep. 2013, the entire contents and substance of which is hereby incorporated by reference.

BACKGROUND OF THE INVENTION

1. Field of the Invention

The present invention relates to an exercise device support apparatus, and in particular a support apparatus for removably connecting exercise equipment to an exercise frame.

2. Description of Related Art

The increase in the number and variety of exercise equipment and the variety of ways in which exercises may be performed using this equipment has presented fitness clubs and gyms with the problem of accommodating such equipment and providing the space for such a wide range of exercise activities. A typical gym environment will include one or more rooms including a variety of fitness equipment located across the floor space. The fitness equipment may comprise fixed apparatus for performing a specific exercise or exercises, or a means for storing or supporting apparatus such as weights. This equipment requires adequate floor space for both the equipment and the associated exercises. Many current functional training programs such as cross-fit, boxercise, suspension training etc. require a range of different equipment to be used sequentially during training. Much of this equipment requires supports or anchor points to support and hold the equipment during and/or between exercises. Providing dedicated support equipment for such a wide range of equipment not only requires a large amount of space within the gym but is also very costly.

Therefore modular frame structures have been developed to provide support for multiple fitness apparatus at a common location within a gym. Modular support frames provide multiple attachment and support locations for exercise equipment on a common frame structure that typically includes a plurality of upright support legs interconnected by cross brace members that are supported by the legs at an elevated position above the floor space. The legs and cross braces may be assembled in a wide range of different configuration depending on the desired usage of the frame. The cross brace members are used for the attachment and support of suspension training equipment, boxing bags and other exercise equipment which are suspended off the floor from the cross brace either in use or for storage after use. It is also known to permanently secure racks to the uprights for the storage of exercise equipment when not in use. In order to maximize the variety of exercises that may be performed it is undesirable to permanently secure supports for ancillary equipment between the uprights at a level lower that the cross brace members as this limits access in and around the frame. In addition, once a piece of equipment or an equipment support structure is permanently secured to a frame upright no alternative equipment may then be used with that particular frame member, thereby limiting use of the frame.

It is therefore desirable to provide an improved support apparatus for removably connecting fitness equipment to an exercise frame which addresses the above described problems and/or which offers improvements generally.

BRIEF SUMMARY OF THE INVENTION

According to the present invention there is provided a support apparatus as described in the accompanying claims.

In an embodiment of the invention there is provided a support apparatus for removably connecting fitness equipment to an exercise frame, the support apparatus comprising first and second rack sections configured to be fixed in a spaced arrangement to a frame member, each rack section including at least one receiving channel having an opening at one end. A bracket is provided for supporting the fitness equipment, the bracket including at least two locating members corresponding to the first and second rack sections, each configured to be received within the at least one receiving channel of the corresponding rack section, the slots being configured to hold and retain the locating members to support the bracket on the racks. The at least one locating member associated with the first rack section includes a lateral engagement element configured to engage with the first rack section to prevent lateral movement of the bracket when the at least one locating member including the lateral engagement element is received in the corresponding slot of the first rack section to laterally locate and restrain the bracket. The at least one projection associated with the second rack section is configured to be laterally unrestrained within the corresponding slot of the corresponding rack. Laterally unrestrained means that the projection is able to be received within the slot at multiple positions along its length and does not include a stop member to prevent or block lateral movement. The term bracket includes and support element that is able to removably secure to the rack and also provide support to a further element such as an item of fitness that is either permanently or removably secured to the bracket.

The bracket is intended to support heavy weights and/or all or part of a user's weight during use. It is therefore important that lateral movement of the bracket is prevented to avoid the shifting of weights or to avoid the anchor for a user moving when a force is applied to it by a user. It is not possible to form the bracket such that it engages the outer surfaces of the racks to prevent lateral movement as this would rely on a high tolerance in the width of the upright legs which would be prohibitively expensive. The invention provides a first locating member that locates on the rack at a single position along its length defined by the lateral locating element and laterally secures to the rack such that lateral movement of the bracket is prevented achieves the required lateral restriction. The second locating member is freely movable relative to the corresponding rack and is therefore able to locate into the corresponding channel at any point along its length, thereby accommodating any variances in the width the rack section due to a variance in tolerance of the width of the frame upright to which the rack sections are secured.

The locating members are preferably projections that extend from the bracket.

The bracket preferably comprises first and second side walls spaced from each other and joined by an interconnecting member, the side walls being configured to be arranged adjacent and outwardly spaced from the first and second racks sections. The locating members extending from the first and second walls and are arranged such that when the first and second side walls are located laterally adjacent the rack sections at a selected height corresponding to the vertical location of a pair of channels the at least two locating members are received within the corresponding channels of the rack sections.

The locating members may comprise cylindrical projections having a diameter corresponding to the width of the channels of the rack sections such that the projections are able to slide within the channels. The cylindrical configuration, which may be solid o hollow, allows the projections to slide and be easily received within the channels at any angular orientation. The lateral engagement element may comprise two sections of increased diameter spaced along the at least one projection including the lateral engagement element. The increased diameter sections are preferably formed integrally with the bar, such as by turning down a reduced diameter section from a cylindrical bar. Alternatively, the increased diameter sections may be separate components fixed to the smaller diameter projection.

The spacing of the increased diameter sections corresponds to the thickness of the corresponding rack section such that when the at least one projection including the lateral engagement element is received within the corresponding channel of the rack section the increased diameter sections are slidingly received either side of the channel in a close sliding fit. The reduced diameter section is preferably of the same diameter as the projections of the opposing side of the bracket such that a common channel width may be used on both rack sections.

Each rack section preferably comprises a plurality of channels regularly spaced along its length at equal intervals, the rack sections configured to be arranged in use such that channels are vertically spaced from each other. Each side section of the bracket includes two inwardly facing locating projections laterally aligned and vertically spaced apart the same distance as the spacing of the channels or a multiple thereof, with the projections of the first and second side walls being located at common corresponding positions. The projections of both sides of the bracket are both vertically and laterally aligned such that they are equally spaced between the front and rear edges of the side walls. The front edge of the side walls is the open distal edge that is placed over the side of the upright first. The distance of the projections from the rear edge is at least equal to the lateral distance between the inner end of the channels of the racks and the outer edges of the rack sections including the openings to the channels.

Each channel is preferably configured such that when the rack section is vertically oriented in use the channels slope downwardly away from the opening. This prevents the brackets from sliding out of the channels in use. The bracket may only be removed if a user intentionally lifts the bracket out of the channels.

The downwardly sloping section of each channel may substantially straight and the channels are arranged along the rack section such that the straight sections of each channel are parallel to each other thereby ensuring that the projections are able to slide in parallel in vertically adjacent channels.

Each channel preferably includes a terminal holding section at the opposing end of the channel to the opening that is configured to extend downwardly from the previous section of the channel when the rack section is vertically oriented in use. This acts to laterally lock the bracket in position and prevent lateral movement in the second lateral direction perpendicular to the axis of the projections.

The support bracket preferably comprises a first plate section defining the interconnecting body of the bracket, with the first and second wall sections comprising plate sections extending in a substantially perpendicular direction from opposing ends of the body such that the bracket is substantially u-shaped.

The side walls are preferably spaced a distance greater than the spacing of the rack sections such that the inner faces of the side walls are spaced from the rack sections a combined distance at least equal to the distance between the inner surface of the side wall from which the projections including the lateral engagement elements extend and the start of the reduced diameter section taken from the inner surface of the side wall. This ensures that the first increased diameter section adjacent the side wall is able to slide in the gap between the side wall and the rack section.

The rack sections preferably includes spacer members extending from their inner surfaces which in use are located adjacent the side walls of the respective upright, the spacers being configured to space the rack section from the upright at least a distance equal to the thickness second distal lateral engagement element to allow the second lateral locating element to slide between the inner surface of the rack section and the outer surface of the upright. The spacers also provide the laterally unrestricted projection lateral variation in both directions to locate at the required lateral position to accommodate the width of the upright.

One of the increased diameter lateral engagement elements is located at the distal end of the corresponding locating projection and the rack sections each comprise a substantially elongate planar body and spacer elements located on the inner face of the planar body which faces the frame section in use that are configured to space the planar body from the frame element to define a gap for accommodating the distal increased diameter lateral engagement element.

The projections including the lateral engagement elements only extend from one side wall of the bracket, with the projections of the other side wall being free to move laterally relative to their corresponding channels. This allows the brackets to be lateral restricted relative to the rack sections when located on the rack due to the rack being laterally locked relative to one of the rack sections, while the other side of the rack is able to locate at a plurality of later positions to accommodate variances in eth spacing of the rack sections.

The at least one lateral engagement element preferably comprises a pair of discs having a diameter greater than the width of the channels, the discs being interspaced by a cylindrical section of smaller diameter than the disc sections having a diameter corresponding to the width of the channels of the rack sections such that it is able to slide within the channels.

The outer surface of one of the side walls preferably includes a support element for supporting an exercise device. The support element may include a permanently fixed connection to an exercise device secured directly to the bracket or a support for removably receiving and supporting an exercise device.

The opposing side wall of the bracket to the support element preferably includes a handle extending from the outer surface to enable a user to lift and locate the bracket on the rack.

BRIEF DESCRIPTION OF THE DRAWINGS

Various features and advantages of the present invention may be more readily understood with reference to the following detailed description taken in conjunction with the accompanying drawings, wherein like reference numerals designate like structural elements, and in which.

DETAILED DESCRIPTION OF PREFERRED EMBODIMENTS

Figure 1:
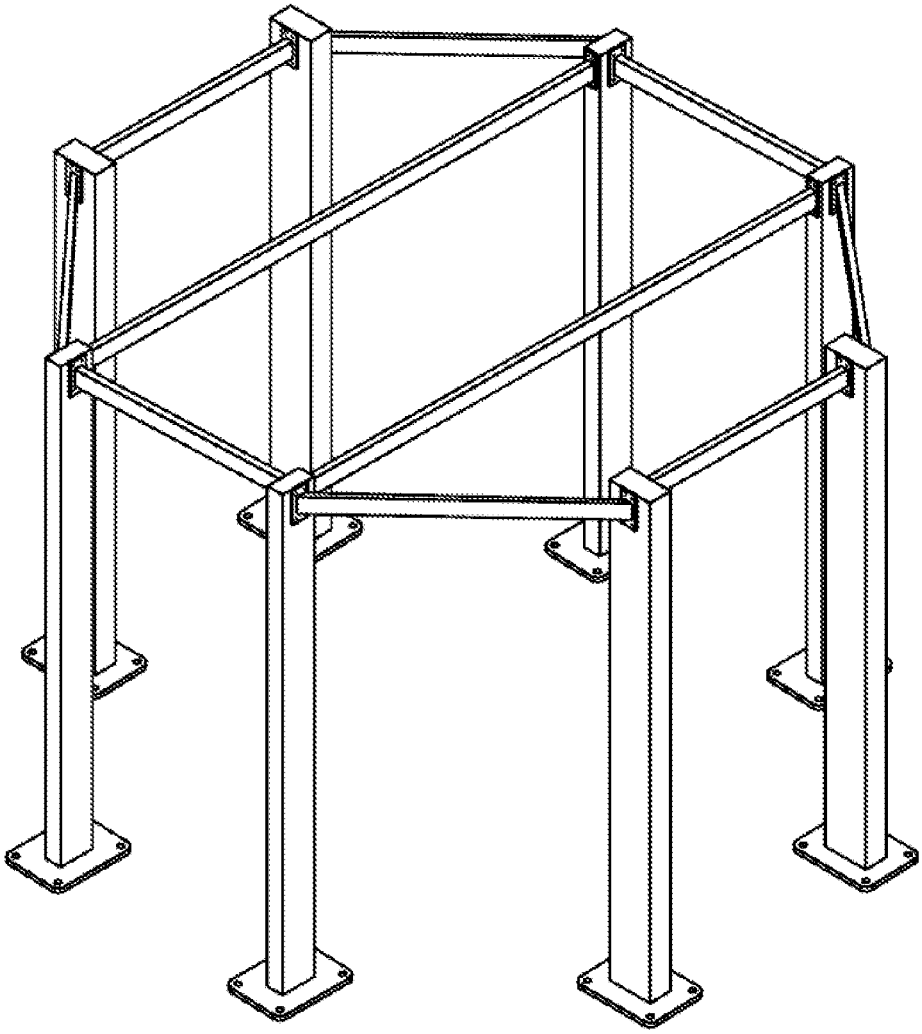
FIG. 1 shows a modular exercise frame.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

Referring to FIG. 1 a modular exercise fame 1 comprises a plurality of upright support legs 2 interconnected by a plurality of corresponding cross beams 4 which interconnect the legs 2 towards their upper ends. The legs 2 and cross beams 4 may be interconnected in a multitude of different configurations to provide any desired frame configuration. The support frame 1 defines within and surrounding the perimeter of the feet 6 at floor space 8 defining an exercise zone. The cross beams 4 provide overhead supports for the attachment of exercise equipment such as punch bags or suspension trainers. This enables the equipment to be suspended for use and stored off the floor post use, thereby freeing up the floor space for additional training. The frame 1 is therefore able to define a training zone within a gym providing a dedicated location for multiple training activities. To improve the flexibility of the support frame 1 the applicant has considered additional functionality to increase the number of exercise activities that may be supported by the frame 1. In addition to suspending equipment from the support cross beams 4 the applicant has considered utilizing the upright supports to support and retain a variety of additional exercise equipment.

Figure 2:
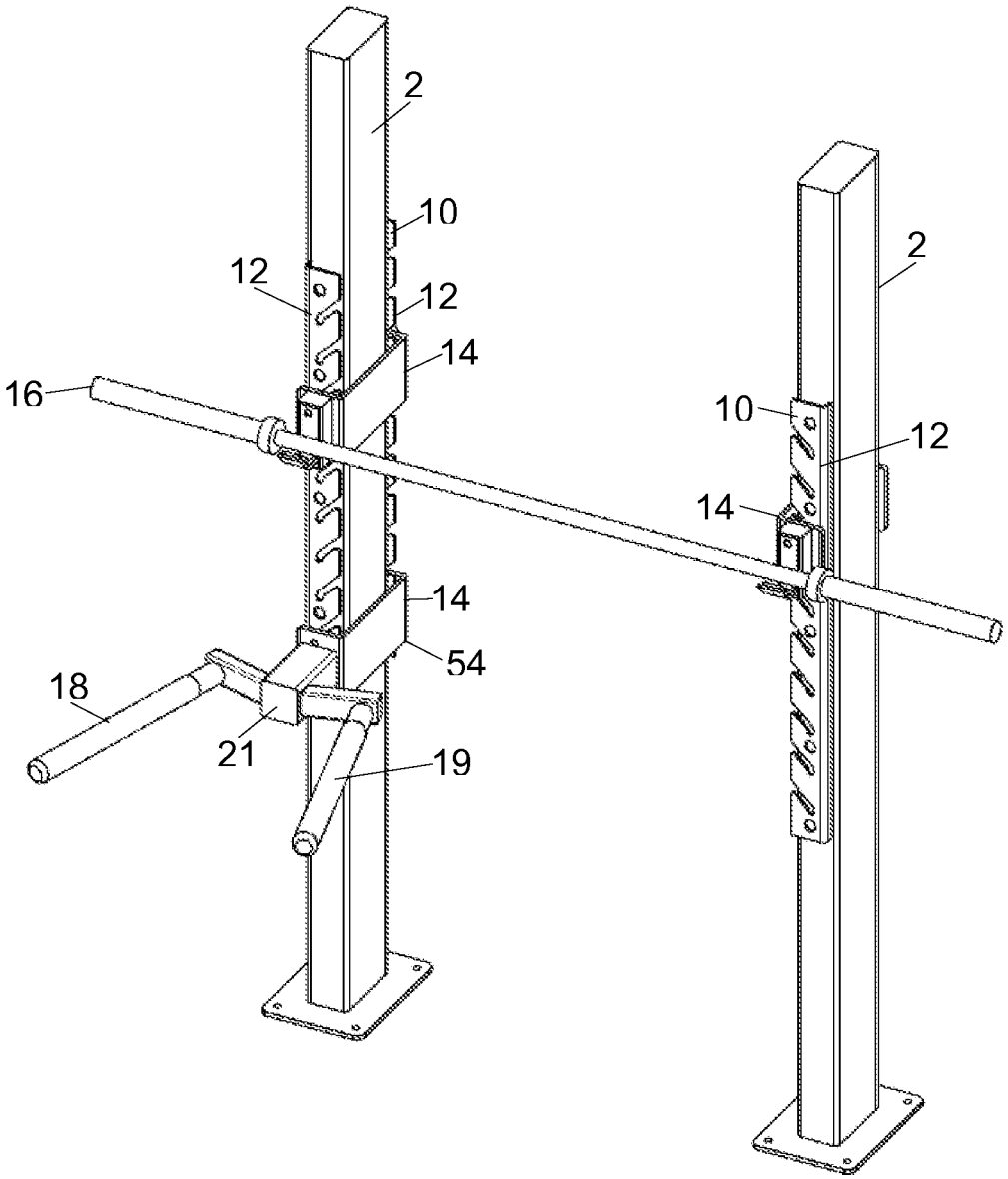
FIG. 2 shows two support apparatus according an embodiment of the present invention secured to adjacent upright supports to hold and support an Olympic bar.

Referring to FIG. 2 a rack 10 is provided for supporting equipment on the upright legs 2 of a frame 1. Each rack section 10 includes a pair of rack sections 12 configured to be arranged on opposing sides of an upright support 2. The racks 10 are configured to support and retain corresponding brackets 14 which may include attachment points or supports for various fitness equipment such as the Olympic bar 16 shown in FIG. 2 and/or may have specific items of fitness equipment directly secured thereto, such as the dip bars 18 also shown in FIG. 2.

Figure 3:
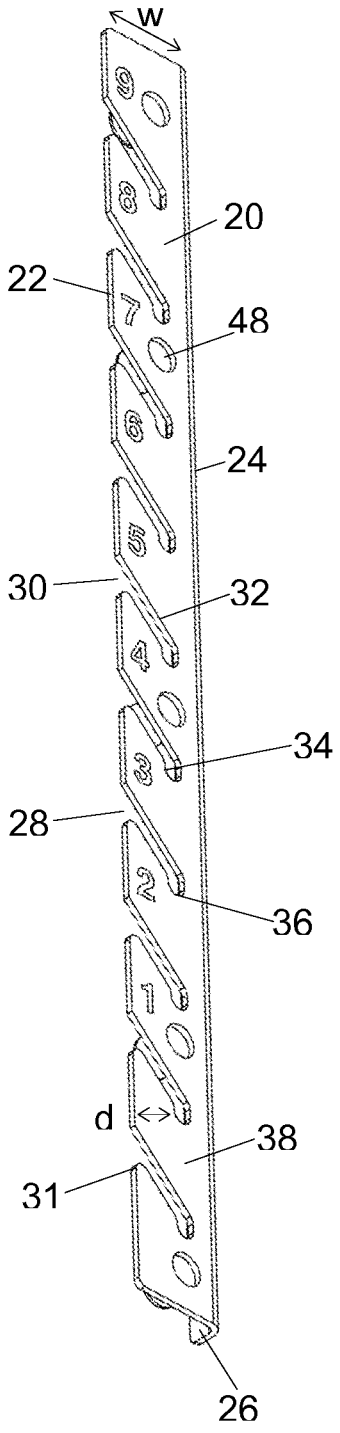
FIG. 3 is an isometric view showing the outer surface of a rack section according to an embodiment of the invention.

As shown in FIG. 3, each rack section 12 includes an elongate plate 20 having a width w substantially equal to the width of a corresponding upright leg support 2. Along the length of the plate 20 a front edge 22 is defined that is the receiving edge for receiving the corresponding bracket 14, and an opposing rear edge 24. The rear edge 24 is bent through 90° such that it defines a rear wall 26 substantially perpendicular to the main plate 20. A plurality of slots 28 are formed in the plate 20. Each slot 28 includes an opening 30 in the front edge 22. Each slot or channel 28 includes a straight front section extending inwardly into the plate 20 from the opening 30 and sloping in a downwards direction away from the opening 30 towards the rear edge 24 when the rack section is oriented vertically such that its longitudinal axis is vertically extending. Each front slot section 32 leads into a rear slot section 34 which extends substantially vertically downwards defining a downwards change in the angle of the slot 28. The rear section 34 defines the end of the slot 28 and includes a curved base 36 defining a receiving cradle. The end section 36 of the slot 28 is spaced from the rear edge 24. The inflection point of the curved receiving cradle 36 is located a distance d from the front edge 22 of the rack 20. The slots 28 are regularly spaced along the length of the rack 20 with each slot 28 opening to the front edge 22. The angle of each slot 28 is the same such that the sloping front sections 32 of each slot 28 are arranged parallel to each other in the vertical direction with the rearward vertical slot sections 34 being vertically aligned.

Figure 4:
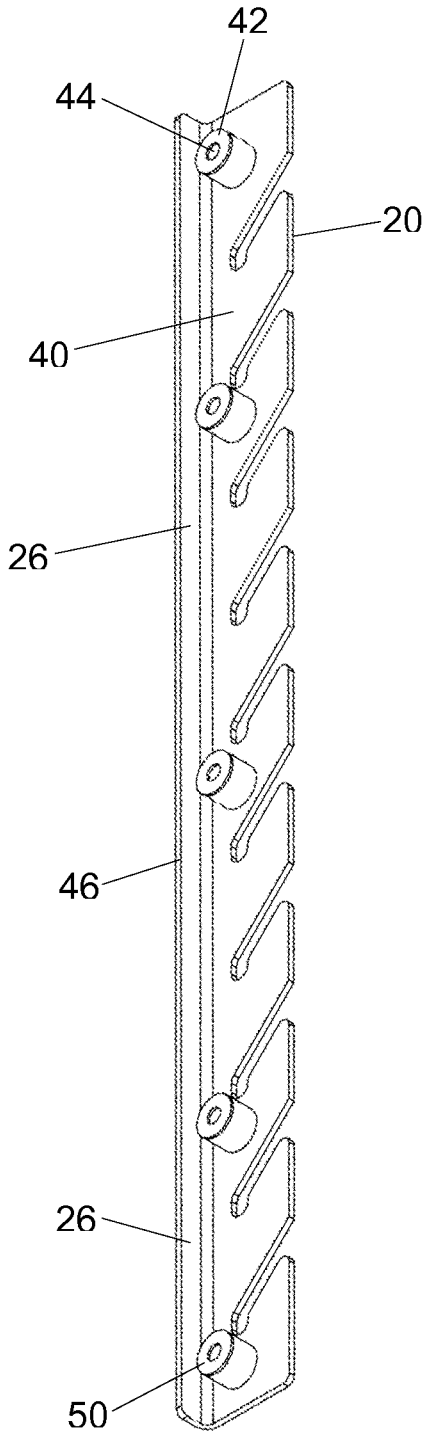
FIG. 4 is an isometric view showing the inner surface of a rack section according to an embodiment of the invention.

The rack 20 has an outer face 38 which is the outer surface of the main plate section which faces away from the upright 2 when the rack 10 is connected to the upright. The opposing inner surface 40, as shown in FIG. 4, faces towards the upright in use. A plurality of spigots 42 are secured to and project from the inner surface 40 normal to the surface. Each spigot 42 is a substantially cylindrical member having an inner bore 44. The spigots 42 extend away from the inner surface 40 to substantially the same distance as the inner edge 46 of the rear wall 26. The spigots 42 are aligned with corresponding apertures 48 formed in the plate 20 such that they are open at both ends. The bore 44 of each spigot 42 is configured to receive a fastener for securing the rack 20 to an upright member 2 of the support frame 1. The cylindrical body of the spigots 42 act as spacers with the annular inner surface 50 abutting the upright 2 such that the spigots 42 space the plates 20 from the upright 2 a distance equal to the length of each spigot 42. Preferably the inner edge 46 of the rear wall 26 is also configured to abut the upright 2 to provide rearward support.

Figure 5:
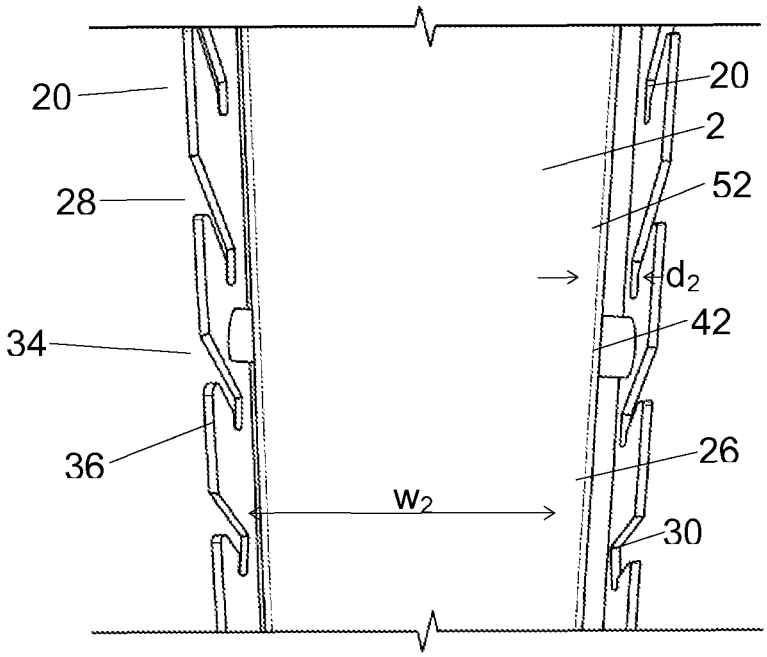
FIG. 5 is a view from the front of a section of upright having rack sections according an embodiment of the present invention secured thereto.

The pair of racks sections 20 is secured to opposing sides of the upright support leg 2 at common vertical and lateral positions relative to their width. Apertures are formed in the upright 2 at locations corresponding to the locations of the spigots 42 for receiving fasteners extending through the spigots 42. The apertures are located at common locations either side of the upright support such that the rails 20 are vertically and transversely aligned with the front edges 22 of each rail being aligned laterally and the slot 28 being vertically aligned. As can be seen in FIG. 5 the spigots 42 space the plates 20 a distance d2 from the side walls of the upright 2 to which they are secured defining a gap 52.

Figure 6:
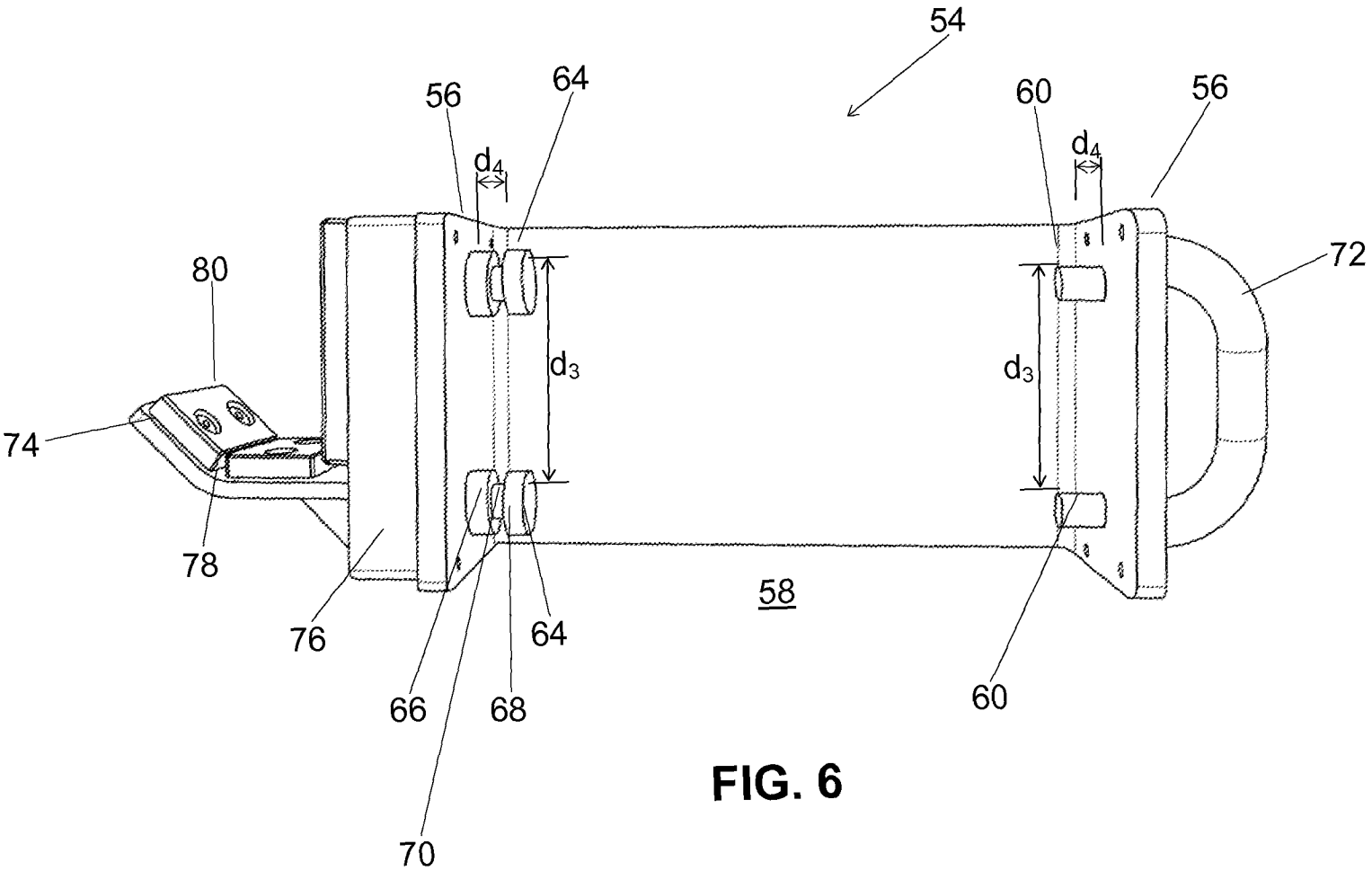
FIG. 6 shows a bracket according an embodiment of the present invention.
Figure 7:
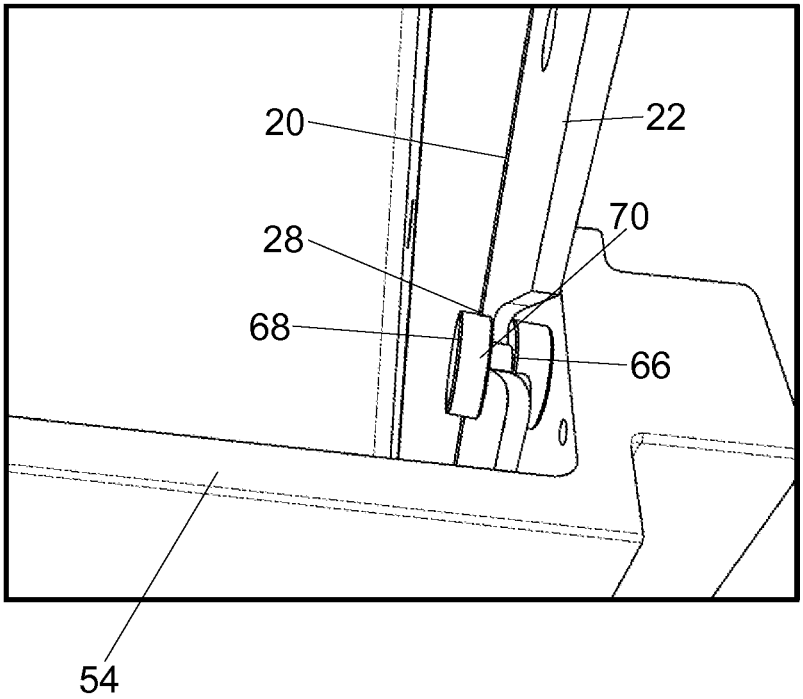
FIG. 7 is an enlarged view of the later locating elements arranged about the channel of a rack section according an embodiment of the present invention.

A support bracket 54 is shown in FIG. 6. The bracket 54 includes a front wall 56 and opposing side walls 58 extending from the opposing ends of the front wall 54 in a perpendicular direction. An opening 58 is defined between the free ends 60 of the side walls 56 such that when viewed from above the bracket has a substantially "U" shaped configuration. The front wall 56 and side walls 58 are formed from a plate metal material and are secured to each other at their adjoining edges by welding or any other suitable joining means. Alternatively the bracket 54 may be formed from a single plate material that is bent towards it ends to form the side walls or formed from any other suitable process. A fair of locating lugs 60 project from the inner surface of one of the side walls 56 inwardly into the bracket 54. The lugs 60 are cylindrical bars or pegs and are secured to the end wall 56 by any suitable means. The lugs 60 have a diameter sized to fit within the slots 28 of the racks 20. The tolerance is selected such that the lugs 20 are received in the slots 28 with a smooth sliding fit but with minimal play. The lugs 60 are vertically spaced a distance of d3 which is equal to the vertical spacing of the slots 28 such that when the upper lug 60 is received in a slot the lower lug 60 is simultaneously received in the slot 28 immediately beneath that slot. The diameter of the curved cradle section 36 corresponds to the diameter of the lugs 60 such that the lugs 60 seat in the receiving cradle section 36.

A further pair of locating guide lugs 64 extends from the inner surface of the other side wall 56 at corresponding locations to the first set of lugs 60. The central axis of the lugs 64 are spaced by a distance of d3, the same distance as the spacing of the central axis of the first set of locating lugs 60. The second set of locating lugs 64 include a first enlarged diameter section 66 and a second enlarged diameter section 68 that are interspaced by a reduced diameter section 70. The enlarged diameter sections 66 and 68 are both substantially disc shaped and have a diameter that is greater than the reduced diameter section 70. The reduced diameter section 70 has a diameter which is substantially equal to the diameter of the first set of locating lugs 60. The diameter of the inner enlarged diameter section 66 and the outer enlarged diameter section 68 is greater than the width of the slots 28. The length of the reduced diameter section 70 which defines the spacing between the enlarged diameter sections 66 and 68 if selected to correspond to the thickness of the plate material of the rack 20 such that when the reduced diameter section is introduced into a slot 28 the enlarged diameter section 66 and 68 locate either side of the slot in a closely toleranced fit that permits the reduced diameter sections 60 of the locating lug 74 to slide within the slot while simultaneously minimizing any lateral movement of the locating lugs 64.

A handle 72 is provided at one end of the bracket 54 to enable the bracket to be lifted by a user. The handle extends from an outer surface of the one of the end walls 56 in the arrangement shown in FIG. 6. The user lifts the bracket and aligns the locating lugs 60 and 64 with corresponding slots in the pair of rack sections 20. The slots 28 are selected to locate the bracket 54 at a desired height. The lugs 60 are laterally movable within the slots 28 and therefore the user need only vertically align these lugs with the slots 28 and they will enter the slots 28 any location along their length. The enlarged diameter sections 66 and 68 of the second set of locating lugs 64 act as lateral locators and the lugs 64 are only able to engage with the slots 28 at a single lateral position in which the reduced diameter section 70 is aligned with the slot, with the enlarged diameter sections 66 and 68 aligned either side of the slot 28.

The openings 30 to the slots 28 preferably include a curved or chamfered section 31 as shown in FIG. 3, such that the opening or mouth 30 is larger than the main section 32 of the slot 28 to enable the locating lugs 60 and 64 to be more easily located into the slot 28. When both the locating lugs 60 and 64 are vertically and laterally aligned with the slots the user urges the bracket forward towards the racks 20 causing the lugs to slide within the slots with the lugs 60 and 64 sliding downwardly along the sloping section 32 of the slots 28 before reaching the end of the sloping section 32 and sliding into the vertical section 36 before seating and locating in the cradle section 36. When properly received in the cradle section 36 the vertical nature of this section of the slot 28 means that the lugs are laterally located with movement in the direction of the front 22 and rear 24 edges prevented. Lateral movement of the bracket 54 is also prevented by the laterally limiting increase diameter sections 66 and 68 either side of the relative slots 28 on one side of the rack 20.

It is important that the bracket 54 locates with a high tolerance within the slots 28 and that lateral movement of the bracket 54 is prevented. Such lateral movement could be prevented if the bracket were formed such that the inner surfaces of the side walls 56 engaged the outer surfaces of the racks 20 when located on the racks. However, this requires a high tolerance not only in the racks 20 but also in the width of the upper right legs. Manufacture of large beam sections to such high tolerances is extremely expensive. By providing the laterally locating discs or increased diameter members 66 and 68 on only one side of the bracket on one set of locating lugs 64 enables the bracket 54 to be formed having a width greater than the largest expected tolerance to enable the bracket to be accommodated about the racks 20 while ensuring lateral securement. As the lateral locators 66 and 68 are only located on one side, while the lugs 64 locate at a specific lateral location the opposing locating lugs 60 are laterally limited and therefore can be accommodated in the corresponding slots 28 at a range of lateral positions thereby accommodating any variances in the width of the upright member 2. It is also important that when located within the slots the brackets are not able to be accidentally dislodged from the racks 20 during use. The downwardly sloping nature of the slots 28 in combination with the vertical sections 36 meant that to remove the bracket the bracket must first be lifted a short vertical distance and then lifted in a sloping manner upwardly through the slots. As such no matter how hard a user may pull laterally or downwardly on the brackets it is impossible for them to become dislodged.

The brackets 54 may be configured to support a variety of exercise equipment. Each bracket 54 includes a support means of some description for supporting a piece of equipment and/or a user during exercise. In the arrangement shown in FIG. 6 the bracket 54 includes a cradle or bracket 74 for supporting an elongate bar such as an Olympic weightlifting bar. In order to support an item such an Olympic bar two brackets 54 including bar cradles 74 must be secured to adjacent legs 2 such as is shown in FIG. 2. The brackets 54 are located on the racks 20 at corresponding heights such that the bar cradles 74 are vertically aligned and are able to support a bar 16 in a horizontal orientation. The bar cradle 74 includes a body section 76 that is screwed or otherwise secured to the end wall 56 of the bracket 54. A support plate 78 extends horizontally from the body section 76 and slopes upwardly at this distal end. Resilient pads 80 are secured to the upper surface of the floor plates 78 to cushion and grip the bar 16 with the sloping front section restraining the bar 16 from rolling off the distal end of the cradle 74. An alternative exercise apparatus 18 is also shown in FIG. 2 which comprises a dip bar including two projecting bars 19 which are spaced to accommodate the user with the user gripping the bars 19 to perform dip exercises. The bars 19 are secured via body section 21 to the bracket 54. A wide range of exercise devices are contemplated for use with the support bracket arrangement with the bracket 54 and rack 20 providing a means for releasably securing an exercise device or a support for an exercise device to an upright of the frame. This releasable securement allows the exercise frame 1 to be easily reconfigured for a wide range of various exercise programs rather than having a more restricted number of rigid and permanently fixed auxiliary apparatus secured directly and permanently to the legs 2.

It will be appreciated that in further embodiments various modifications to the specific arrangements described above and shown in the drawings may be made. For example, the lateral locating elements are referred to as being of an increased diameter as compared to the rest of the locating projection, the term 'diameter' does not limit this element to being circular. Here the term diameter means the largest dimension of that element taken in a plane transverse to the longitudinal axis of the element in question.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A support apparatus for removably connecting exercise equipment to an exercise frame, the support apparatus comprising:

first and second rack sections configured to be fixed in a spaced arrangement to a frame member, each rack section including a planar body having a thickness, a front edge and a rear edge, and a receiving channel having a width and extending inwardly into the planar body from a opening in the front edge and sloping in a downwards direction away from the opening towards the rear edge;

a bracket for supporting the exercise equipment, the bracket including two locating members, one each corresponding to the first and second rack sections, and each configured to be received within the receiving channel of the corresponding rack section, the channels configured to hold and retain the locating members to support the bracket on the racks;

wherein the locating member associated with the first rack section includes a first enlarged diameter section and a second enlarged diameter section that are interspaced by a reduced diameter section, the diameters of the first enlarged diameter section and the second enlarged diameter section being greater than the width of the receiving channel, the length of the reduced diameter section defining the spacing between the first enlarged diameter section and the second enlarged diameter section sized to cooperatively engage the thickness of the planar body such that when the reduced diameter section is introduced into the receiving channel, the first enlarged diameter section and the second enlarged diameter section locate either side of the receiving channel in a closely toleranced fit; and wherein the locating member associated with the second rack section is configured to be laterally unrestrained within the corresponding channel of the corresponding rack such that it is able to be located within the channel at multiple lateral positions.

2. The support apparatus according to claim 1, wherein the bracket comprises first and second side walls spaced from each other and joined by an interconnecting member, the side walls being configured to be arranged adjacent and spaced from the first and second racks sections, wherein the locating members extending from the first and second walls and are arranged such that when the first and second side walls are located adjacent the rack sections, the locating members are received within the corresponding channels of the racks sections.

3. The support apparatus according to claim 1, wherein the locating member associated with the second rack section and the reduced diameter section of the locating member associated with the first rack section comprise cylindrical projections having a diameter corresponding to the width of the channels of the rack sections such that the projections are able to slide within the channels, and wherein the closely toleranced fit of the locating member associated with the first rack section permits the reduced diameter section to slide within the channel while simultaneously minimizing lateral movement of the first enlarged diameter section and the second enlarged diameter section.

4. The support apparatus according to claim 1, wherein the closely toleranced fit of the locating member associated with the first rack section provides a close sliding fit of the reduced diameter section within the channel.

5. The support apparatus according to claim 4, wherein each rack section comprises a plurality of channels regularly spaced along its length at equal intervals, the rack sections configured to be arranged in use such that channels are vertically spaced from each other, and wherein each side section of the bracket includes two inwardly facing locating projections laterally aligned and vertically spaced apart the same distance as the spacing of the channels or a multiple thereof, with the projections of the first and second side walls being located at common corresponding positions.

6. The support apparatus according to claim 5, wherein each channel is configured such that when the rack section is vertically oriented in use the channel slopes downwardly away from the opening.

7. The support apparatus according to claim 6, wherein the downwardly sloping section of each channel is substantially straight and the channels are arranged along the rack section such that the straight sections of each channel are parallel to each other.

8. The support apparatus according to claim 7, wherein each channel includes a terminal holding section at the opposing end of the channel to the opening that is configured to extend downwardly from the previous section of the channel when the rack section is vertically oriented in use.

9. The support apparatus according to claim 8, wherein the support bracket comprises a first plate section defining the interconnecting body of the bracket, with the first and second wall sections comprising plate sections extending in a substantially perpendicular direction from opposing ends of the body such that the bracket is substantially u-shaped.

10. The support apparatus according to claim 9, wherein the side walls are spaced a distance greater than the spacing of the rack sections such that the inner faces of the side walls are spaced from the rack sections a combined distance at least equal to the distance between the inner surface of the side wall from which the locating member associated with the first rack section extends and the start of the reduced diameter section taken from the inner surface of the side wall.

11. The support apparatus according to claim 10, wherein one of the enlarged diameter sections is located at a distal end of a corresponding locating member, and wherein the rack sections each comprise a substantially elongate planar body and spacer elements located on an inner face of the planar body which faces the frame section in use that are configured to space the planar body from the frame element to define a gap for accommodating the distal enlarged diameter section.

12. The support apparatus according to claim 10, wherein an outer surface of one of the side walls includes a support element for supporting an exercise or an exercise device fixed thereto.

13. The support apparatus according to claim 12, wherein an opposing side wall includes a handle extending from an outer surface to enable a user to lift and locate the bracket on the rack.

14. The support apparatus according to claim 9, wherein one of the enlarged diameter sections is located at a distal end of a corresponding locating member, and wherein the rack sections each comprise a substantially elongate planar body and spacer elements located on an inner face of the planar body which faces the frame section in use that are configured to space the planar body from the frame element to define a gap for accommodating the distal enlarged diameter section.

15. The support apparatus according to claim 1, wherein the enlarged diameter sections of the locating member associated with the first rack section are located on the locating member and are configured to prevent lateral movement of the bracket in both lateral directions.

16. A support apparatus for removably connecting exercise equipment to an exercise frame, the support apparatus comprising:

first and second rack sections configured to be fixed in a spaced arrangement to a frame member, each rack section including at least one receiving channel having an opening at one end;

a bracket for supporting the exercise equipment, the bracket including at least two locating members corresponding to the first and second rack sections each configured to be received within the at least one receiving channel of the corresponding rack section, the channels being configured to hold and retain the locating members to support the bracket on the racks, wherein the at least one locating member associated with the first rack section includes a lateral engagement element configured to engage with the first rack section to prevent lateral movement of the bracket when the at least one locating member including the lateral engagement element is received in the corresponding channel of the first rack section to laterally locate and restrain the bracket, and the at least one locating member associated with the second rack section is configured to be laterally unrestrained within the corresponding channel of the corresponding rack such that it is able to be located within the channel at multiple lateral positions;

wherein the locating members comprise cylindrical projections having a diameter corresponding to the width of the channels of the rack sections such that the projections are able to slide within the channels, and wherein the lateral engagement element comprises two sections of increased diameter spaced along the at least one projection including the lateral engagement element;

wherein the spacing of the increased diameter sections corresponds to the thickness of the corresponding rack section such that when the at least one projection including the lateral engagement element is received within the corresponding channel of the rack section the increased diameter sections are slidingly received either side of the channel in a close sliding fit;

wherein each rack section comprises a plurality of channels regularly spaced along its length at equal intervals, the rack sections configured to be arranged in use such that channels are vertically spaced from each other, and wherein each side section of the bracket includes two inwardly facing locating projections laterally aligned and vertically spaced apart the same distance as the spacing of the channels or a multiple thereof, with the projections of the first and second side walls being located at common corresponding positions;

wherein each channel is configured such that when the rack section is vertically oriented in use the channel slopes downwardly way from the opening;

wherein the downwardly sloping section of each channel is substantially straight and the channels are arranged along the rack section such that the straight sections of each channel are parallel to each other;

wherein each channel includes a terminal holding section at the opposing end of the channel to the opening that is configured to extend downwardly from the previous section of the channel when the rack section is vertically oriented in use;

wherein the support bracket comprises a first plate section defining the interconnecting body of the bracket, with the first and second wall sections comprising plate sections extending in a substantially perpendicular direction from opposing ends of the body such that the bracket is substantially u-shaped;

wherein the side walls are spaced a distance greater than the spacing of the rack sections such that the inner faces of the side walls are spaced from the rack sections a combined distance at least equal to the distance between the inner surface of the side wall from which the projections including the lateral engagement elements extend and the start of the reduced diameter section taken from the inner surface of the side wall; and wherein one of the increased diameter lateral engagement elements is located at a distal end of a corresponding locating projection and wherein the rack sections each comprise a substantially elongate planar body and spacer elements located on an inner face of the planar body which faces the frame section in use that are configured to space the planar body from the frame element to define a gap for accommodating the distal increased diameter lateral engagement element.

17. A support apparatus for removably connecting exercise equipment to an exercise frame, the support apparatus comprising:

first and second rack sections configured to be fixed in a spaced arrangement to a frame member, each rack section including at least one receiving channel having an opening at one end;

a bracket for supporting the exercise equipment, the bracket including at least two locating members corresponding to the first and second rack sections each configured to be received within the at least one receiving channel of the corresponding rack section, the channels being configured to hold and retain the locating members to support the bracket on the racks, wherein the at least one locating member associated with the first rack section includes a lateral engagement element configured to engage with the first rack section to prevent lateral movement of the bracket when the at least one locating member including the lateral engagement element is received in the corresponding channel of the first rack section to laterally locate and restrain the bracket, and the at least one locating member associated with the second rack section is configured to be laterally unrestrained within the corresponding channel of the corresponding rack such that it is able to be located within the channel at multiple lateral positions;

wherein the lateral engagement element comprises two sections of increased diameter spaced along the at least one projection including the lateral engagement element;

wherein each side section of the bracket includes two inwardly facing locating projections laterally aligned and vertically spaced apart the same distance as the spacing of the channels or a multiple thereof, with the projections of the first and second side walls being located at common corresponding positions;

wherein one of the sections of increased diameter of the lateral engagement elements is located at a distal end of a corresponding locating projection and wherein the rack sections each comprise a substantially elongate planar body and spacer elements located on an inner face of the planar body which faces the frame member in use that are configured to space the planar body from the frame member to define a gap for accommodating the distal increased diameter lateral engagement element.

* * * * *